US005787735A

United States Patent [19]

Gunter et al.

[11] Patent Number: 5,787,735

[45] Date of Patent: Aug. 4, 1998

[54] BLEACH LIQUOR RECOVERY SYSTEM

[75] Inventors: Johnnie G. Gunter; Grant A. Hurd, both of Pulaski; Marlie R. Crotts, Cana, all of Va.

[73] Assignee: Surry Chemicals, Inc., Mount Airy, N.C.

[21] Appl. No.: 540,796

[22] Filed: Oct. 11, 1995

[51] Int. Cl.[6] ..... D06F 39/02

[52] U.S. Cl. ..... 68/18 R; 68/23.5; 68/17 R; 68/207; 222/651

[58] Field of Search ..... 68/23.5, 18 R, 68/17 R, 207, 902; 222/651

[56] References Cited

U.S. PATENT DOCUMENTS

| | | | |
|---|---|---|---|
| 581,052 | 4/1897 | Woolf | 68/18 R |
| 3,018,922 | 1/1962 | Williamson | 68/17 R |
| 3,518,847 | 7/1970 | Duis | 68/18 |
| 3,809,429 | 5/1974 | Jurjans | 68/17 R |
| 4,055,971 | 11/1977 | Hermes | 68/9 |
| 4,074,969 | 2/1978 | Lawrence | 8/125 |
| 4,254,646 | 3/1981 | Selesnick | 68/18 R |
| 4,286,394 | 9/1981 | Gort | 34/76 |
| 4,418,433 | 12/1983 | Moreland et al. | 8/149.1 |
| 4,463,582 | 8/1984 | Saalmann et al. | 68/17 R |
| 4,845,965 | 7/1989 | Copeland et al. | 68/17 R |
| 5,208,930 | 5/1993 | Chabard | 68/17 R |
| 5,232,476 | 8/1993 | Grant | 55/42 |
| 5,285,665 | 2/1994 | Hetrick, Jr. | 68/902 |
| 5,345,637 | 9/1994 | Pastryk et al. | 68/17 R |
| 5,435,157 | 7/1995 | Laughlin | 68/17 R |
| 5,437,169 | 8/1995 | Mitchell et al. | 68/17 R |

FOREIGN PATENT DOCUMENTS

| | | | |
|---|---|---|---|
| 1366141 | 6/1964 | France | 68/17 R |
| 52-18070 | 2/1977 | Japan | 68/17 R |
| 53-9070 | 1/1978 | Japan | 68/17 R |
| 7808214 | 2/1980 | Netherlands | 68/902 |
| 2069010 | 8/1981 | United Kingdom | 68/17 R |
| 2151363 | 7/1985 | United Kingdom | 68/18 R |

OTHER PUBLICATIONS

Book Of Papers; 1995 International Conference & Exhibition of the American Association of Textile.

Chemists and Colorists, Oct. 8–11, 1995 entitled Cotton Hosiery Bleaching With Hydrogen Peroxide.

*Primary Examiner*—Frankie L. Stinson

*Attorney, Agent, or Firm*—Rhodes Coats & Bennett, L.L.P.

[57] ABSTRACT

A bleach liquor recovery system for a commercial bleaching apparatus. The recovery system includes a bleaching tank for bleaching loads of textile fabric items with a predetermined batch volume of bleach liquor and a bleach liquor supply system for providing fresh bleach liquor to the bleaching tank. The bleach liquor supply system includes a chemical mixing system for generating the fresh bleach liquor and a bleach liquor injection line for delivering the fresh bleach liquor from the chemical mixing system to the bleaching tank. A bleach liquor recirculation system is connected to the bleaching tank for reclaiming at least a portion of the bleach liquor from the bleaching tank after bleaching a load of textile fabric items and for recycling the reclaimed bleach liquor into successive loads of textile fabric items in the bleaching tank. In the preferred embodiment, a collection tank stores the reclaimed bleach liquor between the successive loads of textile fabric items. A control system is connected to the bleach liquor supply system and the bleach liquor recirculation system for controlling introduction of the fresh bleach liquor and the reclaimed bleach liquor into the bleaching tank.

50 Claims, 1 Drawing Sheet

BLEACH LIQUOR RECOVERY SYSTEM

BACKGROUND OF THE INVENTION (1) Field of the Invention

The present invention relates generally to a commercial apparatus for bleaching loads of textile fabric items and, more particularly, to a bleach liquor recovery system for reclaiming, storing, and recycling bleach liquor into successive loads of textile fabric items in a single bleaching tank.

(2) Description of the Prior Art

White textile fabric items, such as athletic socks, undergarments, and the like are typically bleached prior to their packaging for sale. Otherwise, the fabric items would tend to have a yellowish-gray appearance instead of the bright white color that consumers have become accustomed to over the years. Conventional bleaching processes for these types of white textile fabric items have traditionally utilized a sodium hypochlorite/hydrogen peroxide bleach liquor in one of two types of commercial bleaching apparatuses: a single "batch-type" apparatus and a continuous "tunnel-type" apparatus.

In a "batch-type" bleaching apparatus, commonly referred to as a washer/extractor unit, all of the process phases, such as bleaching, rinsing, and softening, are performed on a batch of textile fabric items in a single tank. For example, the items are first bleached by washing with a predetermined volume of a conventional bleach liquor. Next, the bleach liquor is drained from the tank and replaced with water to rinse the bleached items. The rinse water is then drained from the chamber and a softening liquid is added. Finally, the items are drained and extracted (spun) before being transferred to a drying apparatus. The single tank "batch-type" apparatus thus functions quite similarly to a household washing machine, but on a much larger scale. However, a typical "batch-type" apparatus tends to be relatively expensive, is mechanically complex, and has a relatively slow batch processing rate. Additionally, because this type of bleaching apparatus drains unused bleaching chemicals to the sewer system, increased chemical costs and an undesirable environmental impact to waste water results.

Another "batch-type" bleaching apparatus that uses a single washer/extractor bleaching tank is commonly referred to as a "paddle tub" machine. A "paddle tub" bleaching apparatus comprises an open-topped vat or tub in which bleaching liquor (and later rinse water and softener) is contained, covering the textile items being processed. A paddle mechanism disposed above the textile items is driven through an upper portion of the bleaching liquor to create a flow pattern that agitates the items, thereby enhancing the bleaching process with no mechanical contact between the paddle and the items being bleached. However, a typical "paddle tub" bleaching apparatus tends to use an undesirably large quantity of water and chemicals for each pound of textile fabric items being processed and, further, has an undesirably low batch processing rate.

Yet another "batch-type" bleaching apparatus that uses a single bleaching tank is commonly referred to as an "atmospheric" or "pressure dye" vessel, which is often used to bleach or dye textile yarn or cloth following the process phases of the aforementioned "batch-type" bleaching apparatuses.

The second type of commercial bleaching apparatus commonly used is the continuous "tunnel-type" apparatus. Such an apparatus is capable of simultaneously bleaching, rinsing, and softening by running a continuous length of fabric or other material through the bleaching apparatus in an assembly-line manner. With a continuous "tunnel-type" apparatus, bleaching chemicals are not drained, but are added only as they are used up in the process.

Below are listed several U.S. patents that disclose various apparatuses for continuously processing lengths of material, such as textile fabrics:

U.S. Pat. No. 3,518,847 to Duis discloses a method for the continuous bleaching or otherwise processing of flexible materials such as cotton textiles. The apparatus includes a recirculating means for withdrawing a portion of the fluid from a chamber in which the materials are located, filtering the fluid to remove impurities, and then recharging it back to the chamber. The apparatus contains a supply means for adding sufficient fluid to maintain the volume at a constant level in the chamber. The fluid is recirculated and filtered during normal operation of chemical treatment of the flexible materials.

U.S. Pat. No. 4,055,971 to Hermes discloses a closed-cycle apparatus for continuous and waterless dyeing of a textile or plastic material. The apparatus is constructed to operate under substantially non-aqueous conditions with essentially complete recovery and reuse of the treating fluids. Residual dye is recycled back to the apparatus and, depending on where the residual dye is initially collected, "make-up" or additional dye may be added from a dye storage reservoir when needed.

U.S. Pat. No. 4,074,969 to Lawrence discloses a continuous process for recycling and reuse of gaseous effluents, in particular spent ammonia, in which liquid ammonia make-up flow to the treatment chamber is derived from the retained liquid body in a desuperheating vessel which receives the spent process vapors.

U.S. Pat. No. 4,286,394 to Gort discloses a multiple chamber system for recovering the residues of solvents which remain in textiles during continuous processing of the textiles. Solvent concentration is reduced in a steam lock in steps toward the exit of the textiles from a processing chamber followed by recovery of the solvent residues in the steam.

U.S. Pat. No. 4,418,433 to Moreland et al. discloses a method and system for reusing and reclaiming gum and water used in a continuous carpet dyeing process. The gum is filtered and passed through a heat exchanger into a gum storage tank for reuse. Latent heat is recovered and used to minimize energy requirements of the system.

U.S. Pat. No. 5,232,476 to Grant discloses a solvent recovery and reclamation system, which includes a pressure chamber for receiving the product, a vacuum pump, and a solvent recirculating system for admitting the solvent into the chamber. The solvent recirculating system includes, among other things, a gas/liquid separator for separating the gas and liquid components of the solvent discharged from the chamber, a first closed-loop system connected to the separator to return the gas to the chamber, and a second closed-loop system also connected to the separator to return the liquid to the chamber.

While saving water and chemicals, continuous fabric treatment apparatuses, such as the "tunnel-type" bleaching apparatus described above, tend to be unduly complicated and expensive. In addition, they are typically less reliable and more prone to break-downs than single "batch-type" bleaching apparatuses.

Thus, there remains a need for a new and improved commercial bleaching apparatus that combines the respective benefits of single tank "batch-type" bleaching apparatuses and continuous "tunnel-type" bleaching apparatuses while, at the same time, saving water, bleaching chemicals, and energy by recovering the used bleach liquor from the single bleaching tank of a "batch-type" apparatus after bleaching a load of textile fabric items and then reusing the reclaimed bleach liquor in successive loads.

SUMMARY OF THE INVENTION

The present invention is directed to a bleach liquor recovery system for a commercial bleaching apparatus. The recovery system includes a bleaching tank for bleaching loads of textile fabric items with a predetermined batch volume of bleach liquor and a bleach liquor supply system for providing fresh bleach liquor to the bleaching tank.

The bleach liquor supply system includes a chemical mixing system for generating the fresh bleach liquor and a bleach liquor injection line for delivering the fresh bleach liquor from the chemical mixing system to the bleaching tank.

A bleach liquor recirculation system is connected to the bleaching tank for reclaiming at least a portion of the bleach liquor from the bleaching tank after bleaching a load of textile fabric items and for recycling the reclaimed bleach liquor into successive loads of textile fabric items in the bleaching tank. In the preferred embodiment, a collection tank stores the reclaimed bleach liquor between the successive loads of textile fabric items.

A control system is connected to the bleach liquor supply system and the bleach liquor recirculation system for controlling introduction of the fresh bleach liquor and the reclaimed bleach liquor into the bleaching tank. The control system includes a flow meter connected to the bleach liquor recirculation system for determining the volume of the reclaimed bleach liquor; a pump connected to the bleach liquor supply system for controlling the supply of the fresh bleach liquor from the bleach liquor supply system into the bleaching tank in accordance with the volume of the reclaimed bleach liquor; and a flow meter connected to the chemical mixing system for controlling the mixing of the water and bleach liquor chemicals to generate the fresh bleach liquor.

Accordingly, one aspect of the present invention is to provide a bleach liquor recovery system for a commercial bleaching apparatus, comprising: (a) a bleaching tank, including a water inlet and a drain outlet, for bleaching loads of textile fabric items with a predetermined batch volume of bleach liquor; (b) a bleach liquor supply system for providing fresh bleach liquor to the bleaching tank, the bleach liquor supply system comprising: (i) a chemical mixing system, including a water inlet and connected to a bleach liquor chemical source, for generating the fresh bleach liquor and (ii) a bleach liquor injection line for delivering the fresh bleach liquor from the chemical mixing system to the bleaching tank; (c) a bleach liquor recirculation system connected to the bleaching tank for reclaiming at least a portion of the bleach liquor from the bleaching tank after bleaching a load of textile fabric items and for recycling the reclaimed bleach liquor into successive loads of textile fabric items in the bleaching tank; and (d) a control system connected to the bleach liquor supply system and the bleach liquor recirculation system for controlling introduction of the fresh bleach liquor and the reclaimed bleach liquor into the bleaching tank.

Another aspect of the present invention is to provide a control system for a bleach liquor recovery system for a commercial bleaching apparatus having a bleaching tank for bleaching successive loads of textile fabric items with a predetermined batch volume of bleach liquor; a bleach liquor supply system, which includes a chemical mixing system for generating fresh bleach liquor from water and bleach liquor chemicals, for supplying the fresh bleach liquor to the bleaching tank; and a bleach liquor recirculation system for reclaiming at least a portion of the bleach liquor from the bleaching tank, storing the reclaimed bleach liquor in a collection tank, and recycling the reclaimed bleach liquor back into the bleaching tank; the control system comprising: (a) means connected to the bleach liquor recirculation system for determining the volume of the reclaimed bleach liquor; (b) means connected to the bleach liquor supply system for controlling the supply of the fresh bleach liquor from the bleach liquor supply system into the bleaching tank in accordance with the volume of the reclaimed bleach liquor; and (c) means connected to the chemical mixing system for controlling the mixing of the water and bleach liquor chemicals to generate the fresh bleach liquor.

Still another aspect of the present invention is to provide a bleach liquor recovery system for a commercial bleaching apparatus, comprising: (a) a bleaching tank, including a water inlet and a drain outlet, for bleaching loads of textile fabric items with a predetermined batch volume of bleach liquor; (b) a bleach liquor supply system for providing fresh bleach liquor to the bleaching tank, the bleach liquor supply system comprising: (i) a chemical mixing system, including a water inlet and connected to a bleach liquor chemical source, for generating the fresh bleach liquor and (ii) a bleach liquor injection line for delivering the fresh bleach liquor from the chemical mixing system to the bleaching tank; (c) a bleach liquor recirculation system connected to the bleaching tank for reclaiming at least a portion of the bleach liquor from the bleaching tank after bleaching a load of textile fabric items and for recycling the reclaimed bleach liquor into successive loads of textile fabric items in the bleaching tank; (d) a collection tank for storing the reclaimed bleach liquor between the successive loads of textile fabric items; and (e) a control system connected to the bleach liquor supply system and the bleach liquor recirculation system for controlling introduction of the fresh bleach liquor and the reclaimed bleach liquor into the bleaching tank; the control system including: (i) means connected to the bleach liquor recirculation system for determining the volume of the reclaimed bleach liquor; (ii) means connected to the bleach liquor supply system for controlling the supply of the fresh bleach liquor from the bleach liquor supply system into the bleaching tank in accordance with the volume of the reclaimed bleach liquor; and (iii) means connected to the chemical mixing system for controlling the mixing of the water and bleach liquor chemicals to generate the fresh bleach liquor.

These and other aspects of the present invention will become apparent to those skilled in the art after a reading of the following description of the preferred embodiment.

DESCRIPTION OF THE PREFERRED EMBODIMENTS

Figure 1:
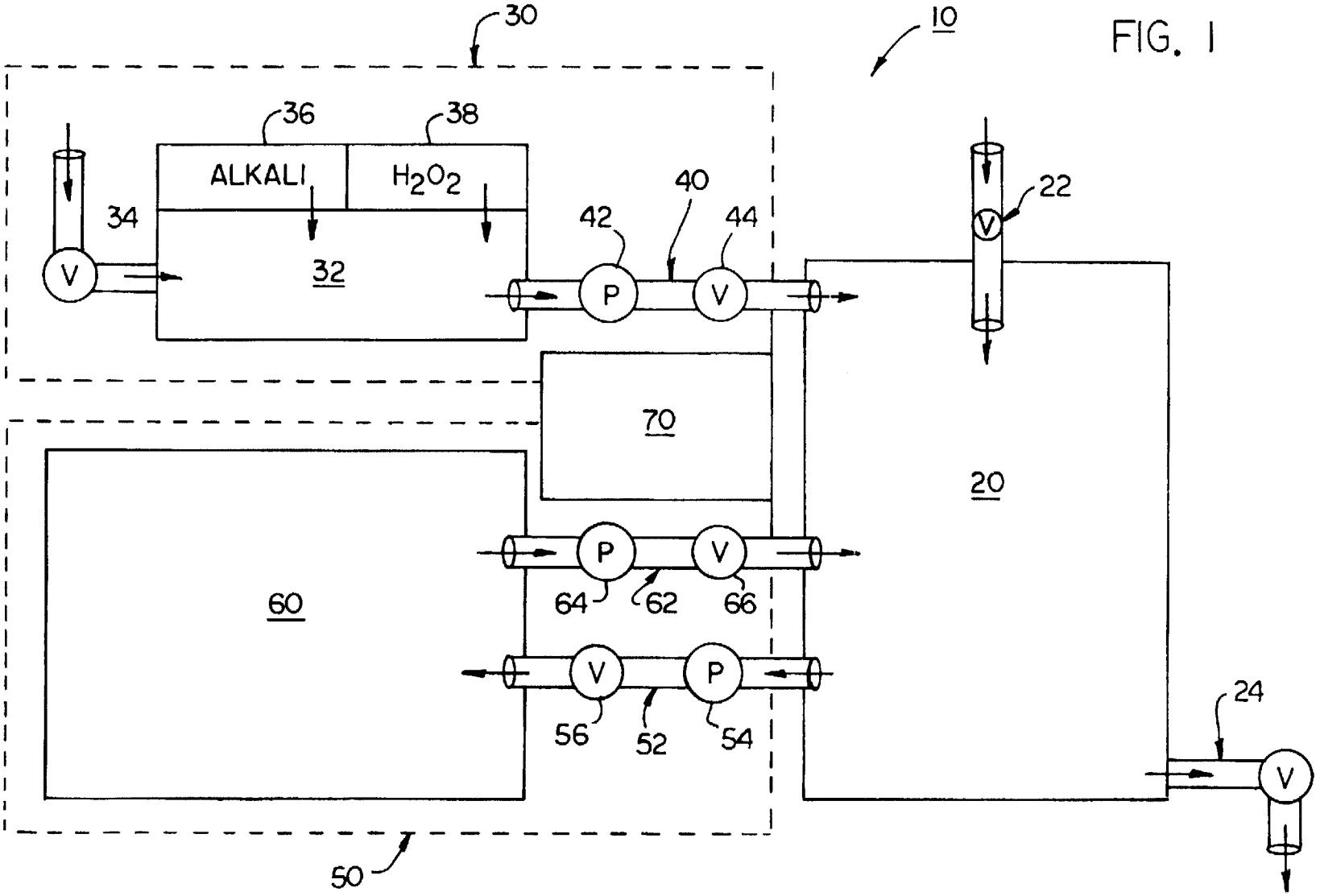
FIG. 1 is a schematic representation of a bleach liquor recovery system constructed according to the present invention, which shows the flow pathway of bleach liquor into and through the system.

In the following description, it is to be understood that such terms as "forward", "rearward", "left", "right", "upwardly", "downwardly", and the like are words of convenience and are not to be construed as limiting terms.

The present invention is a bleach liquor recovery system for a commercial bleaching apparatus. The present invention is designed to impart the primary benefit of continuous "tunnel-type" bleaching apparatuses, which is the resource-conserving recycling of bleach liquor, to single-tank "batch-type" bleaching apparatuses. As referred to herein, a single "batch-type" tank is one in which all phases of a commercial bleaching process take place, including bleaching, rinsing, and softening, as compared to a system in which the items to be bleached are continuously moved through a series of tanks or treatment tunnels. Accordingly, the bleach liquor recovery system of the present invention is designed to be used with a "batch-type" washer/extractor unit, a "paddle-tub" machine, or an "atmospheric" or "pressure dye" vessel.

In the present invention, the bleach liquor employed is preferably a conventional aqueous bleach liquor having hydrogen peroxide ($H_2O_2$) and an alkali bleaching agent such as sodium hypochlorite. However, it should be understood that any conventional commercial bleaching agent, as well as any other type of conventional chemical used as a textile fabric treatment, could be used with the apparatus and method of the present invention.

Referring now to FIG. 1, this drawing schematically depicts the bleach liquor recovery system of the present invention, generally designated with the numeral 10. As represented in FIG. 1, the system 10 generally includes three mechanical subcomponents: a bleaching tank 20 for bleaching loads of textile fabric items; a bleach liquor supply system, which is collectively designated by the numeral 30, for providing fresh bleach liquor to the bleaching tank 20; and a bleach liquor recirculation system, which is collectively designated by the numeral 50, for reclaiming at least a portion of the bleach liquor from the bleaching tank 20 after a load of textile fabric items has been bleached and then recycling the reclaimed bleach liquor into successive loads of textile fabric items. The bleach liquor recovery system 10 also includes a control system, generally indicated by the numeral 70, which is connected to the bleach liquor supply system 30 and the bleach liquor recirculation system 50, for controlling the input of bleach liquor into the bleaching tank 20 from both the bleach liquor supply system 30 and the bleach liquor recirculation system 50.

The bleaching tank 20, as indicated above, is preferably a single "batch-type" tank of the type commonly used in the textile industry to bleach loads of textile fabric items one batch at a time. It should be understood that the bleaching tank 20 may be a washer/extractor unit, a "paddle-tub" machine, or an "atmospheric" or "pressure dye" vessel.

As is conventional, the bleaching tank 20 includes a water inlet 22 for filling the bleaching tank 20 with water during the rinse and softening cycles and a drain outlet 24 with a drain valve for draining the bleaching tank 20 between rinse cycles and after the softening cycle. While the bleaching tank 20 could be any volume, a typical bleaching tank 20 would normally hold up to approximately 400 gallons of bleach liquor or water and be capable of processing approximately a 400 pound batch of items to be bleached.

Turning next to the bleach liquor supply system 30, this system generally includes two subsystems: a chemical mixing system 32 for generating fresh bleach liquor from water and bleach liquor chemicals; and a bleach liquor injection line 40 for delivering the fresh bleach liquor from the chemical mixing system 32 to the bleaching tank 20. A water inlet 34 feeds into the chemical mixing system 32, which is also connected to a source of bleach liquor chemicals. In FIG. 1, the bleach liquor chemical source is shown including a source of an alkali bleaching agent 36 and a source of hydrogen peroxide 38. Typically, the alkali source 36 and the hydrogen peroxide source 38 would be in concentrated form in separate containers connected by hoses to the chemical mixing system 32.

In an actual embodiment of the present invention, the chemical mixing system 32 may include an arrangement of pumps and valves (not shown) that dilute a predetermined quantity of alkali and/or hydrogen peroxide concentrate with water. Such an arrangement could operate similarly to the chemical feed systems commonly found on commercial dishwashers. These chemical concentrate diluting and mixing systems are commonly known by those skilled in the art of bleaching systems and therefore will not be described herein in detail.

The bleach liquor injection line 40 preferably leads from the chemical mixing system 32 directly into the bleaching tank 20, although it could also lead into collection tank 60, which will be described later. In the preferred embodiment, the bleach liquor injection line 40 includes a pump 42 and a valve 44. During initial filling of the bleaching tank 20 with fresh bleach liquor before bleaching the first batch of textile fabric items, the bleach liquor supply system 30 provides all of the bleach liquor necessary to completely fill the bleaching tank 20 to its predetermined batch volume. Later, during the bleaching cycles of subsequent batches of items, the bleach liquor supply system 30 only provides a make-up volume of fresh bleach liquor to top off the recycled bleach liquor returned to the bleaching tank 20, as will be described more fully below.

Shown collectively as numeral 50 in FIG. 1, the bleach liquor recirculation system generally includes two subcomponents: recirculation lines 52 and 62; and a collection tank 60. The recirculation lines 52, 62, in conjunction with the collection tank 60, form a closed circulation loop for reclaiming, storing, and recycling bleach liquor between the bleaching cycles of successive loads of items being bleached.

Beginning at the start of the flow path of the bleach liquor through the recirculation system 50, recirculation line 52 acts as a reclamation line leading from the bleaching tank 20 into the collection tank 60. This reclamation line 52 includes a pump 54 and a valve 56 for transferring used, reclaimed bleach liquor from the bleaching tank 20 to the collection tank 60. The collection tank 60 stores the reclaimed bleach liquor between the successive loads of textile fabric items. Like the bleaching tank 20, the collection tank 60 could be made to hold almost any volume; however, to effectively contain all of the reclaimed bleach liquor, the collection tank 60 and the bleaching tank 20 are preferably approximately the same volume. As will be demonstrated more fully later, the reason for providing a collection tank 60 of approximately the same volume as the bleaching tank 20 is that the volume of the bleach liquor reclaimed by the bleach liquor recovery system 10 and stored in the collection tank 60 is substantially as great as the batch volume of bleach liquor in the bleaching tank 20. Finally, recirculation line 62 acts as a recycle line leading from the collection tank 60 back to the bleaching tank 20. Like the reclamation line 52 the recycle line 62 also preferably includes a pump 64 and a valve 66.

Now turning to the control system 70, which is shown generally in FIG. 1 as being connected to the bleach liquor supply system 30 and the bleach liquor recirculation system 50, the control system 70 preferably includes as its heart a microprocessor for directing the functioning of the mechanical components of the recovery system 10. The control system 70 is preferably connected to each of the pumps and valves of the bleach liquor supply system 30 and the bleach liquor recirculation system 50 for automatically controlling the flow of bleach liquor into and through the system. Additionally, the control system 70 is connected to all of the individual components of the chemical mixing system 32, including the valve in water inlet 34, the alkali source 36, and the hydrogen peroxide source 36. For example, if the chemical mixing system 32 embodies an arrangement of valves and pumps for diluting the chemical concentrates with water, the control system 70 would be connected to each of these valves and pumps. To determine the volume of the bleach liquor reclaimed by the bleach liquor recirculation system 50, the control system may include a volume sensor, such as a float-type depth detector, in either the collection tank 60 or in the bleaching tank 20, which would provide a signal to the control system 70 representative of the volume of reclaimed bleach liquor.

To control the initial filling of the bleaching tank 20 with fresh bleach liquor prior to bleaching the first batch of items, the control system 70 directs the chemical mixing system 32 to dilute a predetermined quantity of bleach chemicals from the chemical sources 36, 38 with a predetermined "batch volume" of water. The required chemical concentrations needed to effectively bleach certain fabric items are well known to those skilled in the art.

However, to control the provision of make-up bleach liquor needed to top off the recycled bleach liquor that has been returned to the bleaching tank 20 during successive bleach cycles, the control system 70 must first determine the make-up volume of liquid needed to bring the level in the bleaching tank 20 up to the required batch volume. To do this, the control system 70 detects the volume of the reclaimed bleach liquor then directs the chemical mixing system 32 to provide the quantity of make-up fresh bleach liquor necessary to bring the total volume of bleach liquor in the system up to the batch volume. It should be understood that in normal operation of the bleaching system, some bleach liquor is inevitably lost after each bleach cycle due to the absorbency of the textile fabric items being bleached. Therefore, the reclaimed bleach liquor generally has a volume in the neighborhood of 90% of the batch volume.

While the absorbency of the textile fabric items results in some loss of bleach liquor volume, the levels of the bleaching chemicals in the bleach liquor are more drastically depleted during the bleach cycle. Therefore, although the make-up volume of fresh bleach liquor restores the total volume of bleach liquor to the required batch volume, the concentration of bleaching chemicals in the make-up volume of fresh bleach liquor must be higher than the concentration of bleaching chemicals in the initial fill of fresh bleach liquor to compensate for this depletion during the bleaching process.

It has been found by repeated test titrations that the amount of additional bleaching chemicals needed to bring the bleaching chemical concentrations in the reclaimed bleach liquor back up to normal is relatively consistent from load to load. Therefore, it is not necessary to monitor the chemical levels of the reclaimed bleach liquor between each load. Instead, the control system 70 is preferably programmed to direct the bleach liquor supply system 30 to input the same, predetermined amount of bleaching chemicals into the reclaimed bleach liquor every time make-up bleach liquor is called for. Specifically, a predetermined quantity of the alkali bleaching agent and hydrogen peroxide are diluted with a variable volume of water by the chemical mixing system 32 to form the make-up fresh bleach liquor. As explained above, the volume of make-up water needed is determined in accordance with the measured volume of the reclaimed bleach liquor. To control the dilution of the bleach liquor chemicals, the control system 70 provides signals to the chemical mixing system 32 representative of alkali and hydrogen peroxide titration set points, which are calculated from the data set out below and then programmed into the control system 70.

EXAMPLE

In a bleach liquor recovery system constructed according to the present invention, tests were performed wherein four hundred pound batches of cotton athletic socks were bleached in "batch-type" washer/extractor with a conventional alkali/hydrogen peroxide bleach liquor.

The following is a non-exhaustive list of steps performed in a typical bleaching process:

1. Place socks in bleaching tank 20.
2. Fill the bleaching tank with 384 gallons of fresh bleach liquor from bleach liquor supply system 30.
3. Run at 200 degrees F. for 30 minutes.
4. Extract and pump reclaimed bleach liquor into the collection tank through reclamation line 52.
5. Fill bleaching tank with 384 gallons of water from water inlet 22.
6. Rinse five minutes at 160 degrees F.
7. Drain bleaching tank through drain outlet 24.
8. Refill bleaching tank with 384 gallons of water from water inlet.
9. Rinse 5 minutes at 120 degrees F.
10. Drain.
11. Fill bleaching tank with 384 gallons of water.
12. Add softener.
13. Heat to 110 degrees F. for 10 minutes.
14. Extract at high speed.
15. Unload and put socks in dryer.
16. Refill bleaching tank with reclaimed bleach liquor from collection tank through recycle line 62.
17. Add make-up fresh bleach liquor to bleaching tank.
18. Repeat bleaching cycle for next batch of socks.

A series of tests were performed to measure the depletion of hydrogen peroxide and alkali after each bleach cycle. The concentrations of these bleaching chemicals in the reclaimed bleach liquor were measured, by titration to establish the efficiency of the bleach liquor recovery system 10 in recovering hydrogen peroxide and alkali.

The following are the chemical recovery test results (all %'s are percents by weight):

| Load | % $H_2O_2$ (Fresh Bleach Liquor) | % $H_2O_2$ (Reclaimed Bleach Liquor) | Recovery % |
|---|---|---|---|
| 1 | 9.4 | 4.5 | 47.9 |
| 2 | 8.9 | 4.3 | 48.3 |

-continued

| | | | |
|---|---|---|---|
| 3 | 8.5 | 4.6 | 54.1 |
| 4 | 8.7 | 4.4 | 46.0 |
| 5 | 8.0 | 3.0 | 37.5 |
| | | | Average 47% |

| Load | % alkali (Fresh Bleach Liquor) | % alkali (Reclaimed Bleach Liquor) | Recovery % |
|---|---|---|---|
| 1 | 2.9 | 2.3 | 79.3 |
| 2 | 2.9 | 2.4 | 82.8 |
| 3 | 2.7 | 2.4 | 88.9 |
| 4 | 3.0 | 2.2 | 73.3 |
| 5 | 3.0 | 2.2 | 73.3 |
| | | | Average 79% |

| Load | Collection Tank Temperature (°F.) | Reclaimed Gallons Bleach Liquor | % Reclaimed (of 384 gal) |
|---|---|---|---|
| 1 | 148 | 355 | 92.4 |
| 2 | 151 | 350 | 91.1 |
| 3 | 154 | 352 | 91.7 |
| 4 | 152 | 349 | 90.9 |
| 5 | 150 | 351 | 91.4 |
| | | | Average 91% |

It has been found that the chemical recovery % values are generally constant from load to load. Therefore, the same quantity of chemicals can be added to the reclaimed bleach liquor after each load, greatly simplifying set-up and operation of the system. There is no need to titrate or otherwise monitor the chemical concentrations in the reclaimed bleach liquor after every load. Further, the present invention permits a typical "batch-type" washer/extractor, a "paddle-tub" machine, or an "atmospheric" or "pressure dye" vessel to operate with the chemical, energy, and waste water efficiency of continuous "tunnel-type" bleaching machines by reclaiming and recycling used bleach liquor.

Certain modifications and improvements will occur to those skilled in the art upon a reading of the foregoing description. For example, while the bleach liquor recovery system 10 of the present invention is designed to retrofit existing bleaching apparatuses, the system of the invention could also be incorporated into a bleaching system from its inception. Further, the technology embodied in the present invention could also be used in applications other than in bleaching systems. For example, washing machines or other types of cleaning systems could employ the technology of the present invention to reclaim and reuse cleaning fluids such as wash water. It should be understood that all such modifications and improvements have been deleted herein for the sake of conciseness and readability but are properly within the scope of the following claims.

We claim:

1. A bleach liquor recovery system for a commercial bleaching apparatus, comprising:

(a) a bleaching tank, including a water inlet and a drain outlet, for bleaching loads of textile fabric items with a predetermined batch volume of bleach liquor;

(b) a bleach liquor supply system for providing fresh bleach liquor to said bleaching tank, said bleach liquor supply system comprising: (i) a chemical mixing system, including a water inlet and connected to a bleach liquor chemical source, for generating the fresh bleach liquor and (ii) a bleach liquor injection line for delivering the fresh bleach liquor from said chemical mixing system to said bleaching tank;

(c) a bleach liquor recirculation system connected to said bleaching tank for reclaiming at least a portion of the bleach liquor from said bleaching tank after bleaching a load of textile fabric items and for recycling the reclaimed bleach liquor into successive loads of textile fabric items in said bleaching tank; and (d) a control system connected to said bleach liquor supply system and said bleach liquor recirculation system for controlling introduction of the fresh bleach liquor and the reclaimed bleach liquor into said bleaching tank.

2. The apparatus according to claim 1, further including a collection tank for storing the reclaimed bleach liquor between the successive loads of textile fabric items.

3. The apparatus according to claim 2, wherein said collection tank and the amount of reclaimed bleach liquor from said bleaching tank are approximately the same volume.

4. The apparatus according to claim 2, wherein said collection tank is connected to said bleaching tank by recirculation lines.

5. The apparatus according to claim 4, wherein said recirculation lines include a reclamation line leading from said bleaching tank to said collection tank and a recycle line leading from said collection tank back to said bleaching tank.

6. The apparatus according to claim 5, wherein said reclamation line includes a pump and a valve and wherein said recycle line also includes a pump and a valve.

7. The apparatus according to claim 2, wherein the bleach liquor reclaimed in said collection tank has a volume substantially equal to the predetermined batch volume.

8. The apparatus according to claim 7, wherein the volume of the reclaimed bleach liquor in said collection tank is about 90% of the batch volume.

9. The apparatus according to claim 2, wherein the bleach liquor includes an alkali bleaching agent and wherein the reclaimed bleach liquor consistently includes an alkali level about four-fifths of the fresh bleach liquor.

10. The apparatus according to claim 9, wherein the alkali level of the reclaimed bleach liquor is about 80% of the fresh bleach liquor.

11. The apparatus according to claim 2, wherein the bleach liquor includes a hydrogen peroxide bleaching agent and wherein the reclaimed bleach liquor consistently has a hydrogen peroxide level about one-half of the fresh bleach liquor.

12. The apparatus according to claim 11, wherein the hydrogen peroxide level of the reclaimed bleach liquor is about 50% of the fresh bleach liquor.

13. The apparatus according to claim 1, wherein said bleaching tank is a single batch-type tank in which all phases of a commercial bleaching process, including bleaching, rinsing, and softening, take place.

14. The apparatus according to claim 13, wherein said bleaching tank is a washer/extractor unit.

15. The apparatus according to claim 13, wherein said bleaching tank is a paddle-tub machine.

16. The apparatus according to claim 13, wherein said bleaching tank is a pressure dye vessel.

17. The apparatus according to claim 1, wherein the bleach liquor chemical source of said chemical mixing system includes an alkali source.

18. The apparatus according to claim 1, wherein the bleach liquor chemical source of said chemical mixing system includes a hydrogen peroxide source.

19. The apparatus according to claim 1, wherein said bleach liquor injection line leads from said chemical mixing system directly into said bleaching tank.

20. The apparatus according to claim 19, wherein said bleach liquor injection line includes a pump and a valve.

21. A control system for a bleach liquor recovery system for a commercial bleaching apparatus having a bleaching tank for bleaching successive loads of textile fabric items with a predetermined batch volume of bleach liquor; a bleach liquor supply system, which includes a chemical mixing system for generating fresh bleach liquor from water and bleach liquor chemicals, for supplying the fresh bleach liquor to the bleaching tank; and a bleach liquor recirculation system for reclaiming at least a portion of the bleach liquor from the bleaching tank, storing the reclaimed bleach liquor in a collection tank, and recycling the reclaimed bleach liquor back into the bleaching tank; said control system comprising:

(a) means connected to said bleach liquor recirculation system for determining the volume of the reclaimed bleach liquor;

(b) means connected to said bleach liquor supply system for controlling the supply of the fresh bleach liquor from the bleach liquor supply system into the bleaching tank in accordance with the volume of the reclaimed bleach liquor; and (c) means connected to the chemical mixing system for controlling the mixing of the water and bleach liquor chemicals to generate the fresh bleach liquor.

22. The apparatus according to claim 21, further including means for controlling the concentration of the bleach liquor chemicals in the fresh bleach liquor during initial filling of the bleaching tank prior to washing any loads of textile fabric items.

23. The apparatus according to claim 21, further including means for determining a make-up volume of fresh bleach liquor necessary to make up any difference in volume between the volume of reclaimed bleach liquor and said predetermined batch volume of bleach liquor.

24. The apparatus according to claim 23, further including means for providing a signal to the chemical mixing system proportional to a titration set point of the reclaimed bleach liquor to control the concentration of the bleach liquor chemicals in the make-up volume of fresh bleach liquor.

25. The apparatus according to claim 24, wherein the bleach liquor chemicals include an alkali bleaching agent, and further including means for mixing a predetermined amount of the alkali bleaching agent with water to form the make-up fresh bleach liquor.

26. The apparatus according to claim 24, wherein the bleach liquor chemicals include a hydrogen peroxide bleaching agent, and further including means for mixing a predetermined amount of the hydrogen peroxide bleaching agent with water to form the make-up fresh bleach liquor.

27. A bleach liquor recovery system for a commercial bleaching apparatus, comprising:

(a) a bleaching tank, including a water inlet and a drain outlet, for bleaching loads of textile fabric items with a predetermined batch volume of bleach liquor;

(b) a bleach liquor supply system for providing fresh bleach liquor to said bleaching tank, said-bleach liquor supply system comprising: (i) a chemical mixing system, including a water inlet and connected to a bleach liquor chemical source, for generating the fresh bleach liquor and (ii) a bleach liquor injection line for delivering the fresh bleach liquor from said chemical mixing system to said bleaching tank;

(c) a bleach liquor recirculation system connected to said bleaching tank for reclaiming at least a portion of the bleach liquor from said bleaching tank after bleaching a load of textile fabric items and for recycling the reclaimed bleach liquor into successive loads of textile fabric items in said bleaching tank;

(d) a collection tank for storing the reclaimed bleach liquor between the successive loads of textile fabric items; and (e) a control system connected to said bleach liquor supply system and said bleach liquor recirculation system for controlling introduction of the fresh bleach liquor and the reclaimed bleach liquor into said bleaching tank; said control system including: (i) means connected to said bleach liquor recirculation system for determining the volume of the reclaimed bleach liquor; (ii) means connected to said bleach liquor supply system for controlling the supply of the fresh bleach liquor from the bleach liquor supply system into the bleaching tank in accordance with the volume of the reclaimed bleach liquor; and (iii) means connected to the chemical mixing system for controlling the mixing of the water and bleach liquor chemicals to generate the fresh bleach liquor.

28. The apparatus according to claim 27, wherein said collection tank and the amount of reclaimed bleach liquor from said bleaching tank are approximately the same volume.

29. The apparatus according to claim 27, wherein said collection tank is connected to said bleaching tank by recirculation lines.

30. The apparatus according to claim 29, wherein said recirculation lines include a reclamation line leading from said bleaching tank to said collection tank and a recycle line leading from said collection tank back to said bleaching tank.

31. The apparatus according to claim 30, wherein said reclamation line includes a pump and a valve and wherein said recycle line also includes a pump and a valve.

32. The apparatus according to claim 27, wherein the bleach liquor reclaimed in said collection tank has a volume substantially equal to the predetermined batch volume.

33. The apparatus according to claim 32, wherein the volume of the reclaimed bleach liquor in said collection tank is about 90% of the batch volume.

34. The apparatus according to claim 27, wherein the bleach liquor includes an alkali bleaching agent and wherein the reclaimed bleach liquor consistently includes an alkali level about four-fifths of the fresh bleach liquor.

35. The apparatus according to claim 34, wherein the alkali level of the reclaimed bleach liquor is about 80% of the fresh bleach liquor.

36. The apparatus according to claim 27, wherein the bleach liquor includes a hydrogen peroxide bleaching agent and wherein the reclaimed bleach liquor consistently has a hydrogen peroxide level about one-half of the fresh bleach liquor.

37. The apparatus according to claim 36, wherein the hydrogen peroxide level of the reclaimed bleach liquor is about 50% of the fresh bleach liquor.

38. The apparatus according to claim 27, wherein said bleaching tank is a single batch-type tank in which all phases of a commercial bleaching process, including bleaching, rinsing, and softening, take place.

39. The apparatus according to claim 38, wherein said bleaching tank is a washer/extractor unit.

40. The apparatus according to claim 38, wherein said bleaching tank is a paddle-tub machine.

41. The apparatus according to claim 38, wherein said bleaching tank is a pressure dye vessel.

42. The apparatus according to claim 27, wherein the bleach liquor chemical source of said chemical mixing system includes an alkali source.

43. The apparatus according to claim 27, wherein the bleach liquor chemical source of said chemical mixing system includes a hydrogen peroxide source.

44. The apparatus according to claim 27, wherein said bleach liquor injection line leads from said chemical mixing system directly into said bleaching tank.

45. The apparatus according to claim 44, wherein said bleach liquor injection line includes a pump and a valve.

46. The apparatus according to claim 27, further including means for controlling the concentration of the bleach liquor chemicals in the fresh bleach liquor during initial filling of the bleaching tank prior to washing any loads of textile fabric items.

47. The apparatus according to claim 27, further including means for determining a make-up volume of fresh bleach liquor necessary to make up any difference in volume between the volume of reclaimed bleach liquor and said predetermined batch volume of bleach liquor.

48. The apparatus according to claim 47, further including means for providing a signal to the chemical mixing system proportional to a titration set point of the reclaimed bleach liquor to control the concentration of the bleach liquor chemicals in the make-up volume of fresh bleach liquor.

49. The apparatus according to claim 48, wherein the bleach liquor chemicals include an alkali bleaching agent, and further including means for mixing a predetermined amount of the alkali bleaching agent with water to form the make-up fresh bleach liquor.

50. The apparatus according to claim 48, wherein the bleach liquor chemicals include a hydrogen peroxide bleaching agent, and further including means for mixing a predetermined amount of the hydrogen peroxide bleaching agent with water to form the make-up fresh bleach liquor.

* * * * *